US009115886B2

(12) United States Patent
Lam et al.

(10) Patent No.: US 9,115,886 B2
(45) Date of Patent: Aug. 25, 2015

(54) ROTARY LIGHTING FIXTURE HAVING SPEAKER WITH PLAYBACK FUNCTION

(71) Applicants: TONGFANG GLOBAL LIMITED, Guangdong Province (CN); SHENYANG TONGFANG MULTIMEDIA TECHNOLOGY CO., LTD., Liaoning Province (CN)

(72) Inventors: Th Lam, Guangdong Province (CN); Wen-Sheng Lu, Guangdong Province (CN); Chih-Ming Huang, Guangdong Province (CN); Tsung-Hsien Chuang, Guangdong Province (CN); Christopher Ng, Guangdong Province (CN)

(73) Assignees: Tongfang Global Limited, Shenzhen, Guangdong Province (CN); Shengyang Tongfang Multimedia Technology Co., Ltd., Shenyang, Liaoning Province (CN)

( * ) Notice: Subject to any disclaimer, the term of this patent is extended or adjusted under 35 U.S.C. 154(b) by 146 days.

(21) Appl. No.: 14/069,562

(22) Filed: Nov. 1, 2013

(65) Prior Publication Data

US 2015/0124441 A1 May 7, 2015

(51) Int. Cl.
*F21V 33/00* (2006.01)
*F21K 99/00* (2010.01)

(52) U.S. Cl.
CPC ..... *F21V 33/0056* (2013.01); *F21K 9/00* (2013.01)

(58) Field of Classification Search
CPC ..... F21V 33/0056; F21K 9/00
USPC ..... 362/86, 85, 233, 231, 147
See application file for complete search history.

(56) References Cited

U.S. PATENT DOCUMENTS

| | | | | |
|---|---|---|---|---|
| 5,828,765 | A * | 10/1998 | Gable | 381/386 |
| 8,013,719 | B2 * | 9/2011 | Haase | 340/326 |
| 8,666,104 | B2 * | 3/2014 | Ivey et al. | 381/340 |
| 8,763,750 | B1 * | 7/2014 | Berkman et al. | 181/150 |
| 2008/0225510 | A1 * | 9/2008 | Rocha | 362/86 |
| 2009/0196016 | A1 * | 8/2009 | Massara et al. | 362/86 |
| 2009/0207607 | A1 * | 8/2009 | Haase et al. | 362/234 |

* cited by examiner

*Primary Examiner* — Ali Alavi
(74) *Attorney, Agent, or Firm* — Rosenberg, Klein & Lee

(57) ABSTRACT

A rotary lighting fixture having a speaker with a playback function is revealed herein, comprising a shell having an opening, a speaker fitted inside the shell, and an annular LED module having plural LEDs fitted at the opening of the shell for illumination and playback functions. In addition, the lighting fixture also combines with a power supply base with a rotary function embedded in a ceiling and a wall for substantially saving space in use thereof, promoting interior designs by its aesthetic appearance and adjusting angles of incidence from the LEDs as desired.

8 Claims, 6 Drawing Sheets

ROTARY LIGHTING FIXTURE HAVING SPEAKER WITH PLAYBACK FUNCTION

BACKGROUND OF THE INVENTION

1. Fields of the Invention

The present invention relates to a rotary lighting fixture having a speaker with a playback function, especially to a lighting fixture comprising plural light emitting diodes (LEDs) and a speaker for separately illumination and playback purposes can be combined with a rotary power supply base on a ceiling or a wall and further suitably used in a place or an occasion where multiple sound and light variations are required, such as concerts, theaters, live shows, night clubs, bars, pubs or the like, for substantially saving space in use thereof, promoting interior designs by its aesthetic appearance and adjusting angles of incidence from the LEDs as desired.

2. Descriptions of Related Art

Currently, lighting products available on the market have been extensively used or applied in various fields of art, e.g. outdoor lightings as street lamps or searchlights, and indoor lightings as fluorescent lamps or table lamps. Owing to the quality of human life being continuously promoted with progressive development of science and technology, lightings have been used for not only illumination but also interior design. To achieve the aforesaid purposes in use of lightings as people concern in their life, lightings have been developed to become thinner and more compact.

"Recessed Light" is a representative thin and compact lighting fixture. It is usually applied to combine the interior decoration and the outdoor landscaping not only in harmony with the environment but also for offering of sufficient light to people in viewing the environmental aesthetic aspects resulted therefrom. Conventional ceiling configurations and decorations in many commercial spaces and public spaces usually need to take into consideration more locations left to install speakers for radio playback, however, arranging and decorating an excessive number of recessed lights and speakers in a living space often lead people to feel oppressed or get other uncomfortable negative feelings, when they keep staying in such a space. Furthermore, according to a variety of premises, places, or decorating arrangements, the angle of incidence of the conventional recessed light can't be adjusted at any time to meet users' demands. Although conventional recessed lights are capable of changing angles of incidence thereof, such a change can be made only by adjustment of its pitch angle, which not only involves in an extremely complex structure design including installment of a pivoted mechanism, but usually results in a high production cost.

In addition, the recessed lights are usually installed in a ceiling of a place where strong light is not required (i.e. concerts, theaters, pubs, or restaurants), but their monotonous color light always make fashionable people feel boring, insipid and unexciting. In other words, not only have conventional recessed lights a poor decorative effect, but also cannot create colored light to make people feel excited and pleasant. Therefore, installment of plural recessed lights separately having LEDs of different light colors at a time and control respective start timing of each light by a switch for variations of light and colors have been implemented in this field of art; however, it will involve in a higher cost and a more complex operation, and he gradually unable to meet consumers' various fashionable and novel demands on use of lights in their living space. In order to effectively improve the aforesaid shortcomings of installment and arrangement of conventional recessed lights and/or speakers on a ceiling of a public place for integration of illumination and broadcasting apparatuses, reuse of spaces, change of light incidence angles depending on users' demands, the practitioners or researchers in this art still necessarily endeavor developing proper recessed lights and/or speakers for use in our living places and space.

SUMMARY OF THE INVENTION

Therefore it is a primary object of the present invention to provide a rotary lighting fixture having a speaker with a playback function, especially to a lighting fixture comprising plural LEDs and a speaker for separately illumination and playback purposes can be combined with a rotary power supply base on a ceiling or a wall and further suitably used in a place or an occasion where multiple sound and light variations are required, for substantially saving space in use thereof, promoting interior designs by its aesthetic appearance and adjusting angles of incidence from the LEDs as desired.

In order to achieve the above object, a rotary lighting fixture having a speaker with a playback function is revealed herein to include a shell, a speaker and an annular LED module. This lighting fixture is installed in a power supply base with a rotary function. The shell has a metal bulb socket at one end thereof, an opening at the other end thereof and two latching portions on the surface thereof for engagement with the power supply base. The speaker is disposed on the corresponding combination opening within the shell body and electrically connected to the metal bulb socket. The annular LED module correspondingly disposed at the opening comprises a printed circuit board (PCB) electrically connected to the metal bulb socket, a plurality of LED lights embedded within the PCB and a transparent shade covered on the opening. Accordingly, a lighting fixture of the present invention combines plural LEDs and a speaker together to show illumination and playback functions, and can be embedded on a ceiling or wall by a power supply base with a rotary function for saving space in use thereof, promoting aesthetic aspects of interior designs and adjusting angles of incidence via the power supply base and the height of the lighting fixture to closely match with a rappelled distance and height of a ceiling to vary positions of a light projection depending on users' requirements and space allocation of a ceiling.

The power supply base is provided with two connecting pieces, which can be inserted into the latching portions of the shell. The power supply base is fitted on a ceiling or a wall.

A volume adjustment knob fitted on the surface of the shell is electrically connected to the speaker.

A remote controlled signal receiver fitted inside the shell is electrically connected to the speaker for receipt of signals from a remote controller to turn on or off a power source for the speaker as well as adjust the volume of the speaker.

The speaker is further electrically connected to the printed circuit board, and the printed circuit board further has a control unit for control of a twinkling timing of the LED lights in response to different volume levels of the speaker for the effect of sound and light variations. The LED lights are selected from a group consisting of a red LED, a green LED, a blue LED and a white LED.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
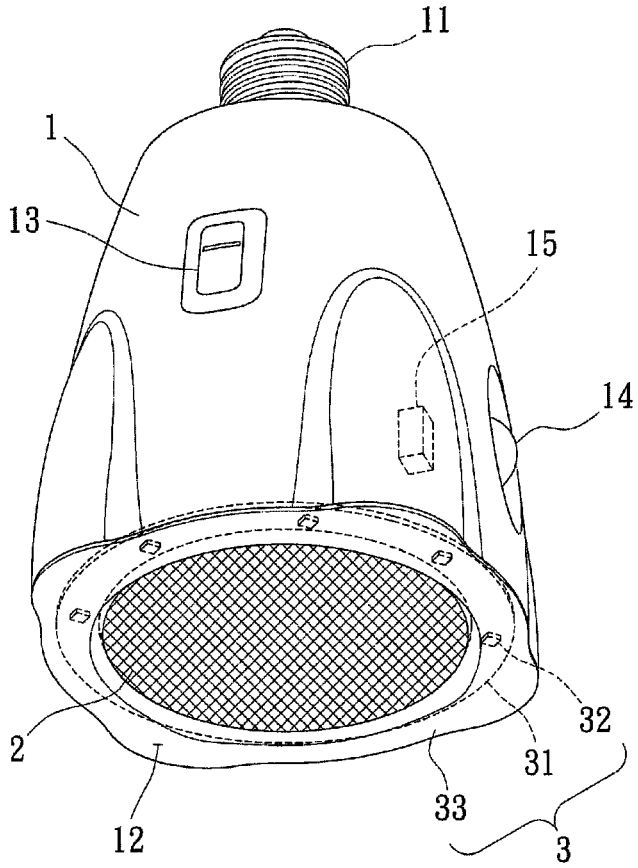
FIG. 1 is a perspective view showing the structure of an embodiment of a rotary lighting fixture according to the present invention.
Figure 2:
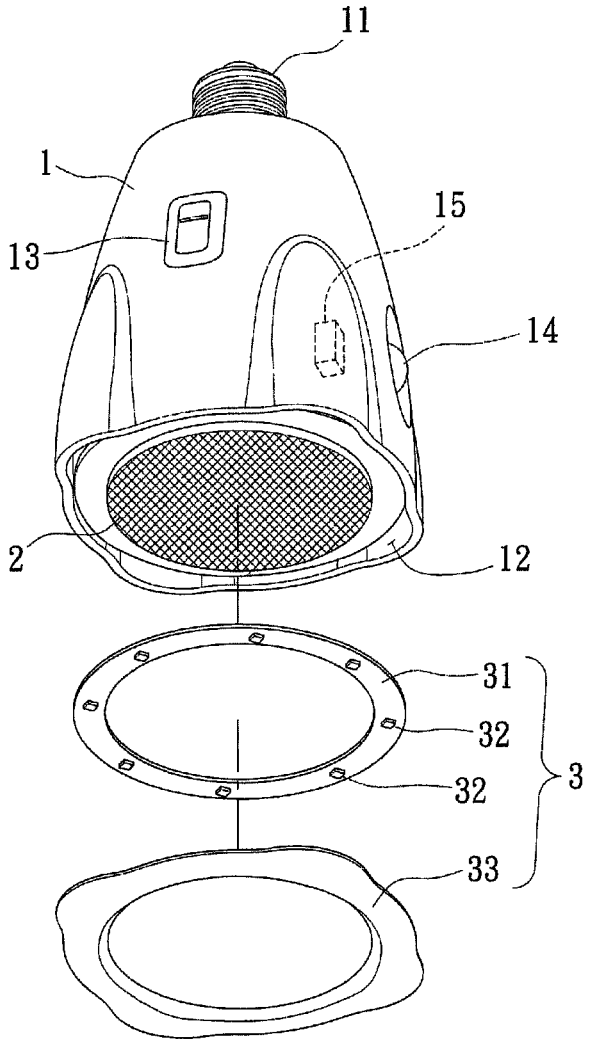
FIG. 2 is an exploded perspective view showing the structure of an embodiment of a rotary lighting fixture according to the present invention.
Figure 3:
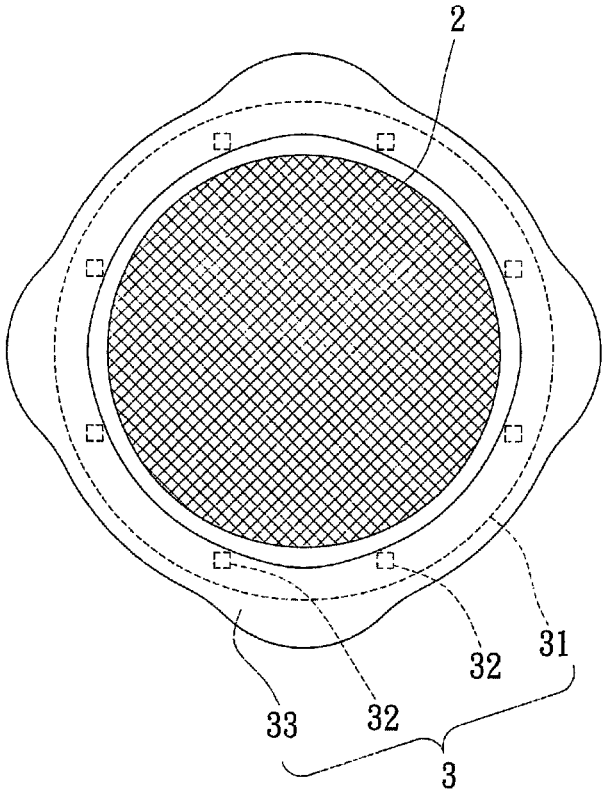
FIG. 3 is a perspective view showing the opening of an embodiment of a rotary lighting fixture according to the present invention.

Please refer to FIG. 1 to FIG. 3, a perspective view showing the structure of an embodiment of a rotary lighting fixture according to the present invention, an exploded perspective view showing the structure of an embodiment of a rotary lighting fixture according to the present invention, and a perspective view showing the opening of an embodiment of a rotary lighting fixture according to the present invention, where a rotary lighting fixture having a speaker with a playback function being installed in a rotary power supply base 4, comprising, A shell 1 having a metal bulb socket 11 at one end thereof, an opening 12 at the other end thereof and two latching portions 13 on the surface thereof for engagement with the rotary power supply base 4.

A speaker 2 disposed inside the shell 1 opposite to the opening 12 and electrically connected to the metal bulb socket 11.

An annular LED module 3 correspondingly disposed at the opening 12 and comprising a printed circuit board 31 electrically connected to the metal bulb socket 11, a plurality of LED lights 32 embedded within the printed circuit board 31 and a transparent shade 33 for covering the opening 12.

Figure 4:
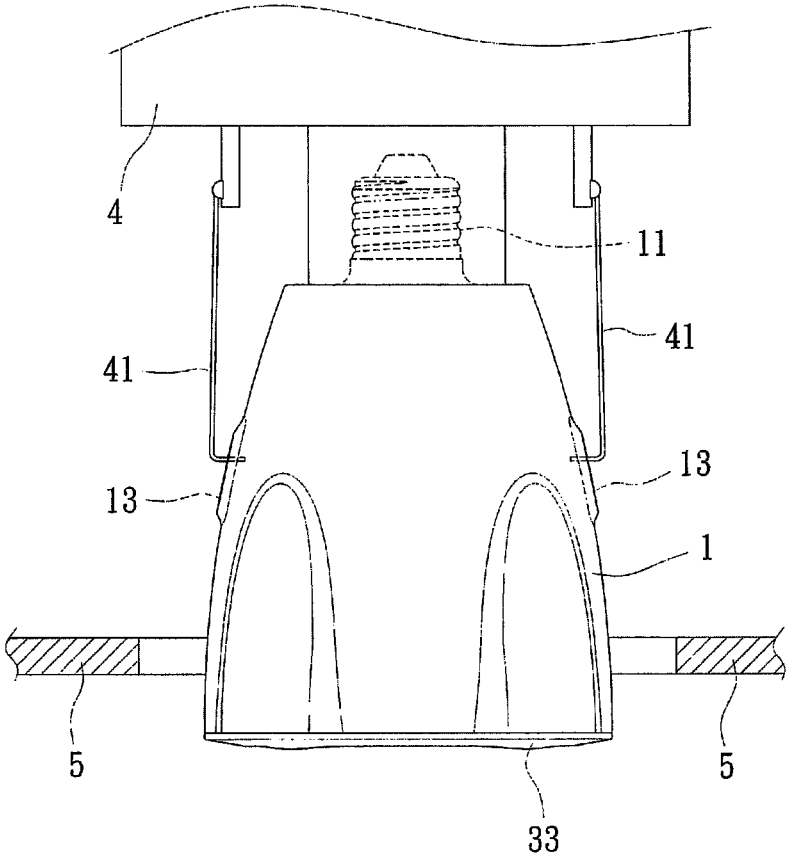
FIG. 4 is a diagram showing the combination of a rotary lighting fixture to a power supply base according to the present invention.
Figure 5:
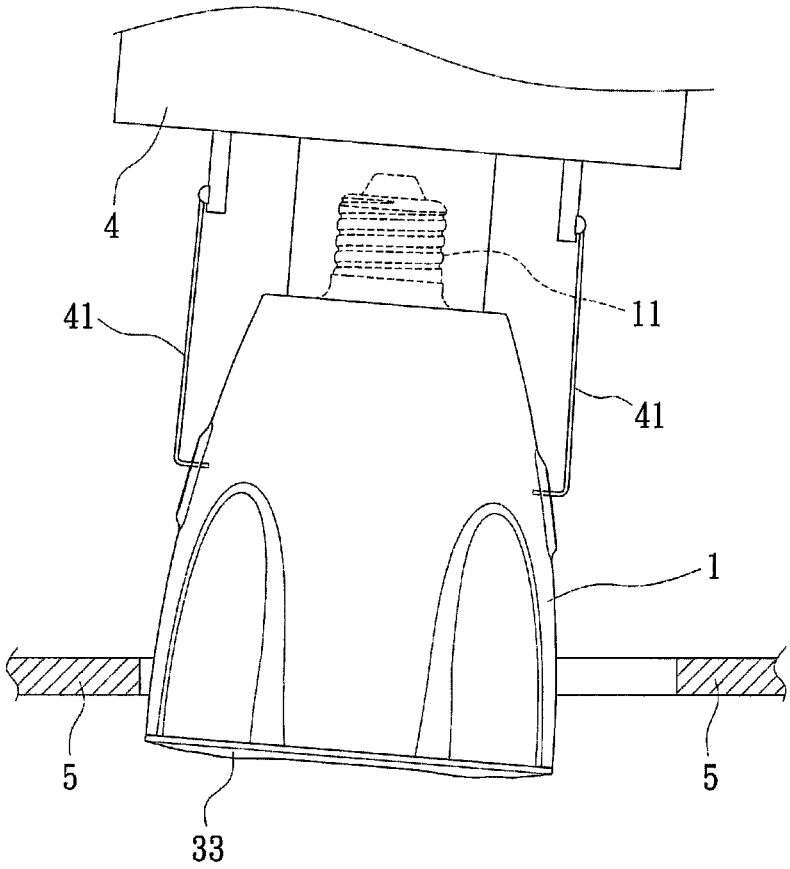
FIG. 5 is a diagram showing a different incidence angle of an embodiment of a rotary lighting fixture according to the present invention.

In addition, please refer to FIG. 4 to FIG. 5, is a diagram showing the combination of a rotary lighting fixture to a power supply base according to the present invention and is a diagram showing a different incidence angle of an embodiment of a rotary lighting fixture according to the present invention, wherein the power supply base 4 is provided with two engaging pieces 41 inserted into the latching portions 13. The power supply base 4 is fitted in a ceiling or a wall depending on users' requirements. Therefore, the height of the lighting fixture can be adjusted to closely match with a rappelled distance.

In addition, the shell 1 is further provided with a volume adjustment knob 14 being electrically connected to the speaker 2 on the surface thereof, and it is provided the users to test and adjust the volume before the lighting fixture installation.

Figure 6:
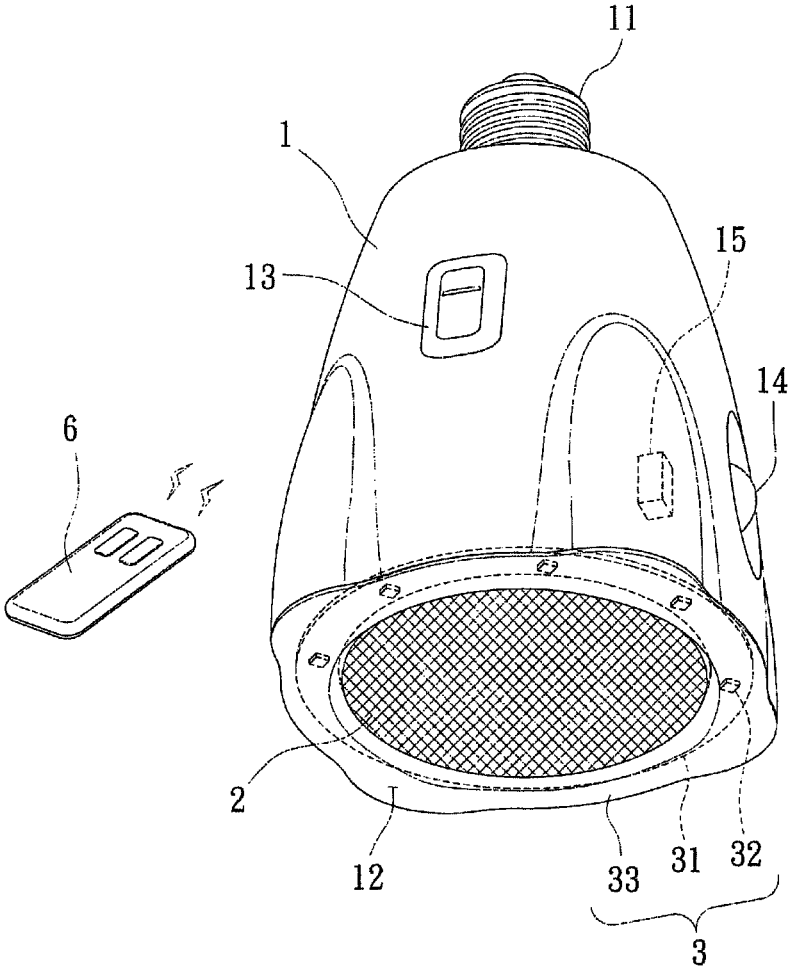
FIG. 6 is a diagram showing a remote controller used in an embodiment of a rotary lighting fixture according to the present invention.

Furthermore, please refer to FIG. 6, a diagram showing a remote controller used in an embodiment of a rotary lighting fixture according to the present invention, wherein the shell 1 is further provided with a remote controlled signal receiver 15 being electrically connected to the speaker 2 therein for receipt of signals from a remote controller 6 to turn on and off a power source for the speaker and adjust the volume of the speaker 2. In addition, the remote controller 6 also controls to turn on and off a power source for the LED lights 32.

In addition, the speaker 2 is electrically connected to the printed circuit board 31 having a control unit for control of a twinkling timing of the LED lights 32 in response to different volume levels of the speaker 2 to achieve the effect of the sound and light change, wherein the LED lights 32 are selected from the group consisting of a red LED, a green LED, a blue LED, and a white LED etc.

In addition, by the following description of an embodiment to further demonstrate the practical application range of the process from the present invention, but the range of the present invention is not limited in any way.

First, the two engaging pieces 41 of the power supply base 4 are connected respectively to the latching portions 13, a user adjusts a movable place of a connection between the engaging pieces 41 and power supply base 4 and a contact between the engaging pieces 41 and the latching portions 13 to adjust the height of the lighting fixture to closely match with a rappelled distance and height of a ceiling. Furthermore, before a user fits the power supply base 4 connected the lighting fixture in a ceiling 5 and a wall, he can test and adjust the volume of the speaker 2 via a volume adjustment knob 14. Finally, after the lighting fixture is installed, a user can rotate the lighting fixture interlocked the power supply base 4 by demand to adjust the projected position of the LED, and the remote controller 6 can turn on and off a power source for the speaker 2 and adjust the volume of the speaker 2. In addition, the remote controller 6 also controls to turn on and off a power source for the LED lights 32. It also controls the twinkling number of the LED lights 32 via electrical device, it effectively meet users' requirements of the bright level and lighting angle.

Furthermore, in a specific implementation, the speaker 2 is electrically connected to the printed circuit board 31 having a control unit for control of a twinkling timing of the LED lights 32 in response to different volume levels of the speaker 2 to achieve the effect of the sound and light change, wherein the LED lights 32 are selected from the group consisting of a red LED, a green LED, a blue LED, and a white LED etc. For example, The LED lights 32 correspondingly turn on and generate the light when the user turns on the speaker 2. When the speaker 2 turns off, the LED lights 32 also turn off the light controlled by PCB 31. Or, when the volume of the speaker 2 increases, the PCB 31 turns off a white LED and turns on a red LED to create the special lighting and visual effects to make people feel exciting and pleasure, and it is suitably used in a place or an occasion where multiple sound and light variations are required, such as concerts, theaters, live shows, night clubs, bars, pubs or the like.

In summary, a rotary lighting fixture having a speaker with a playback function according to the present invention has following advantages compared with techniques available now:

1. The rotary lighting fixture having a speaker with a playback function of the present invention combines plural LEDs and a speaker together to show illumination and playback functions, and can be embedded on a ceiling or wall by a power supply base with a rotary function for saving space in use thereof, and promoting aesthetic aspects of interior designs.

2. The rotary lighting fixture having a speaker with a playback function of the present invention adjusting angles of incidence via the power supply base and the height of the lighting fixture to closely match with a rappelled distance and height of a ceiling to vary positions of a light projection depending on users' requirements and space allocation of a ceiling.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A rotary lighting fixture having a speaker with a playback function being installed in a rotary power supply base, comprising:

a shell having a metal bulb socket at one end thereof, an opening at the other end thereof and two latching portions on the surface thereof for engagement with the rotary power supply base;

a speaker disposed inside the shell opposite to the opening and electrically connected to the metal bulb socket; and an annular LED module correspondingly disposed at the opening and comprising a printed circuit board electrically connected to the metal bulb socket, a plurality of LED lights embedded within the printed circuit board and a transparent shade for covering the opening.

2. The rotary lighting fixture as claimed in claim 1, wherein the power supply base is provided with two engaging pieces inserted into the latching portions.

3. The rotary lighting fixture as claimed in claim 1, wherein the power supply base is fitted in a ceiling or a wall.

4. The rotary lighting fixture as claimed in claim 1, wherein the shell is further provided with a volume adjustment knob being electrically connected to the speaker on the surface thereof.

5. The rotary lighting fixture as claimed in claim 1, wherein the shell is further provided with a remote controlled signal receiver being electrically connected to the speaker therein for receipt of signals from a remote controller to turn on or off a power source for the speaker and adjust the volume of the speaker.

6. The rotary lighting fixture as claimed in claim 4, wherein the shell is further provided with a remote controlled signal receiver being electrically connected to the speaker therein for receipt of signals from a remote controller to turn on or off a power source for the speaker and adjust the volume of the speaker.

7. The rotary lighting fixture as claimed in claim 1, wherein the speaker is electrically connected to the printed circuit board having a control unit for control of a twinkling timing of the LED lights in response to different volume levels of the speaker.

8. The rotary lighting fixture as claimed in claim 1, wherein the LED lights are selected from the group consisting of a red LED, a green LED, a blue LED, and a white LED.

* * * * *